US005350328A

United States Patent [19]

Yagi

[11] Patent Number: 5,350,328

[45] Date of Patent: Sep. 27, 1994

[54] MARINE ENGINE CONTROL SYSTEM

[75] Inventor: Mikiya Yagi, Takarazuka, Japan

[73] Assignee: Nippon Cable System Inc., Takarazuka, Japan

[21] Appl. No.: 34,374

[22] Filed: Mar. 18, 1993

[30] Foreign Application Priority Data

Mar. 19, 1992 [JP] Japan ..... 4-063312

[51] Int. Cl.[5] ..... B60K 41/00

[52] U.S. Cl. ..... 440/84; 114/144 E

[58] Field of Search ..... 114/144 E, 144 A; 440/7, 84, 86, 87, 113; 180/2.1, 315, 335, 336; 350/96.1, 96.16; 455/603, 59

[56] References Cited

U.S. PATENT DOCUMENTS 4,744,322 5/1988 Nakase ..... 114/144 E
5,056,379 10/1991 den Ouden ..... 74/858

FOREIGN PATENT DOCUMENTS 291795 11/1988 Japan ..... 440/86
3-249339 11/1991 Japan .
43-95598 3/1992 Japan .
4-133896 5/1992 Japan .
4-278896 10/1992 Japan .
4-95599 3/2792 Japan .

*Primary Examiner*—Jesûs D. Sotelo
*Attorney, Agent, or Firm*—Armstrong, Westerman, Hattori, McLeland & Naughton

[57] ABSTRACT

Provided is a marine engine control system of small size with a very high operation efficiency, good responsiveness and improved safety. The marine engine control system including a manual remote control stand, an electrically-driven actuator, a controller unit, a first control cable connecting the manual remote control stand with the electrically-driven actuator, and a second control cable connecting the electrically-driven actuator with a subject device to be controlled, wherein the manual remote control stand has an operational lever connected at a base portion thereof to the first control cable, wherein the electrically-driven actuator is provided with a clutch device for achieving connection and disconnection between the first control cable and the second control cable, and a motor for driving the second control cable, and wherein the controller unit has a switch device for switching between a manual operation by the manual remote control stand and an electrically-driven operation by the electrically-driven actuator.

7 Claims, 6 Drawing Sheets

MARINE ENGINE CONTROL SYSTEM

BACKGROUND OF THE INVENTION

The present invention relates to a marine engine control system and, more particularly, to a remote control system for engines of small ships.

In a conventional control system of this type, as shown in FIG. 6, an electrically-driven unit 51 and a remote control stand controlled manually 52 are serially connected with an engine E to be controlled through a push-pull control cable (hereinafter referred to as "cable" simply) 53. The electrically-driven unit 51 comprises a motor, reduction gear box, connecting arm (not shown) and the like and is operated by a remote controller 54 so as to push or pull the cable 53. The manual remote control stand 52, provided with an operational lever 55, is adapted, by means of the operational lever 55, to push or pull the cable 53 which is connected to a base portion thereof.

As described above, in the conventional control system, a cable drum of the electrically-driven unit 51 and the operational lever 55 of the remote control stand 52 are connected to each other through the cable 53. Hence, the electric operation and the manual operation directly cooperate with each other. Consequently when a locking mechanism is exerting on the manual remote control stand 52, operating the cable 53 by the electrically-operated unit 51 would cause the motor to be overloaded and, hence, heat-damaged.

Further, since the cable 53 is connected with the engine electrically-driven unit 51 through the manual remote control stand 52, the length of the cable 53 is inevitably long, which causes backlash and frictional resistance to during the operation thereby decreasing the operation efficiency. Consequently there is required to use a motor of a larger size so as to increase the torque of the electrically-driven unit 51, leading to an increase in cost.

The present invention has been attained to overcome such problems. Thus, it is an object of the present invention to provide a small-sized control system with a very high operation efficiency, good responsiveness and improved safety.

SUMMARY OF THE INVENTION

A marine engine control system including a manual remote control stand, an electrically-driven actuator, a controller unit, a first control cable connecting the manual remote control stand with the electrically-driven actuator, and a second control cable connecting the electrically-driven actuator with a subject device to be controlled, wherein the manual remote control stand has an operational lever connected at a base portion thereof to the first control cable, wherein the electrically-driven actuator is provided with a clutch means for achieving connection and disconnection between the first control cable and the second control cable and a motor for driving the second control cable, and wherein the controller unit has a switch means for changing over between a manual operation by the manual remote control stand and an electrically-driven operation by the electrically-driven actuator.

The above-mentioned clutch means can comprise a first arm having an engagement hole, rotatably mounted on an output shaft of the motor and engaged with the first control cable, a second arm having an engagement hole, secured to the output shaft of the motor and engaged with the second control cable, a plunger having an engagement projection capable of engaging with both the engagement holes, an elastic member for urging the plunger toward the two arms so as to have the engagement projection engage with both the engagement holes, and a solenoid for attracting the plunger against the urging force of the elastic member when energized, so as to pull the engagement projection out of at least the engagement hole of the second arm.

The above-mentioned controller unit is preferably provided with a cancelling means for changing over the electrically-driven operation to the manual operation when the operational lever is manipulated in the electrically-driven operation.

In the control system according to the present invention, when the operation is changed over to the manual operation by the switch means of the controller unit, the clutch means connects the first control cable with the second control cable. Consequently an clutching operation and an accelerating operation for the engine, for example, can be accomplished manually by the operational lever through the first and second control cables.

Further, when the operation is desired to switch to the electrically-driven operation, the clutch means disconnects the first and second control cables from each other. Consequently the clutching operation and the accelerating operation can be accomplished by the motor through the second control cable with the manual remote control stand disabled to operate.

Since the manual remote control stand is thus disabled to operate during the electrically driven operation, no hindrance occurs even if the operational lever of the manual remote control stand is locked. Further, since only the second cable is push-pull driven in the electrically-driven operation, there is a decrease in backlash, frictional resistance and the like in association with the cables because of a shortened length of the cable in service. As a result, a decrease in the operation efficiency can be reduced, while at the same time the electrically-driven actuator, particularly the motor thereof can be scaled down.

DETAILED DESCRIPTION

Figure 1:
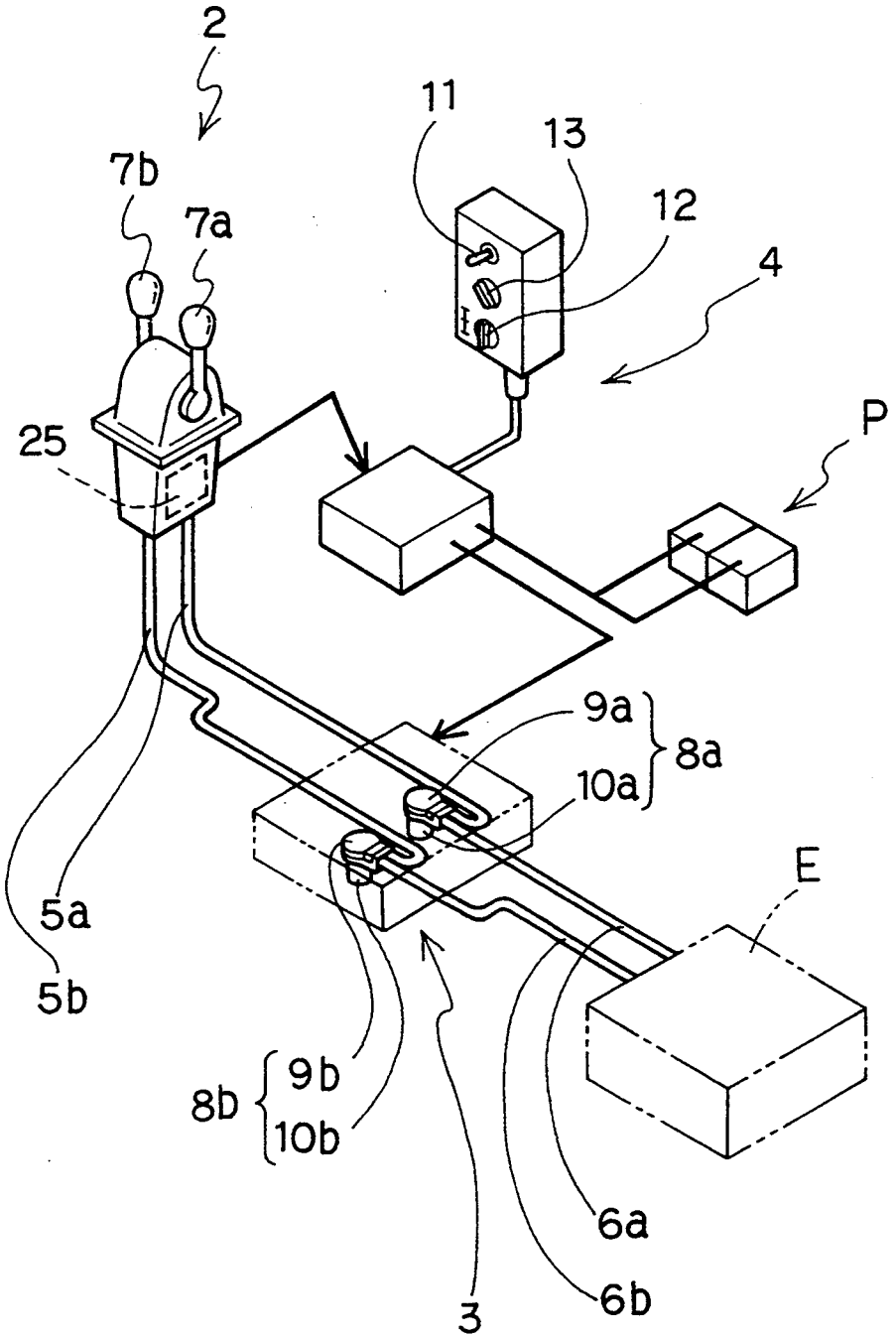
FIG. 1 is a schematic explanatory view illustrating an embodiment of the control system according to the present invention.

Referring to FIG. 1, a control system 1 comprises a manual operating remote control stand (hereinafter referred to as "manual stand") 2, electrically-driven actuator 3 and controller unit 4 for controlling the electrically-driven actuator 3 and, in addition, first control cables (hereinafter referred to as "first cables") 5*a* and 5*b* connecting the manual stand 2 with the electrically-driven actuator 3 and second control cables (hereinafter referred to as "second cables") 6a and 6b connecting the electrically-driven actuator 3 and an engine E. Reference character P denotes a power source.

The first cables consist of a first accelerating cable 5a for an accelerating operation and a first clutching cable 5b for a clutching operation, while the second cables consists of a second accelerating cable 6a for an accelerating operation and a second clutching cable 6b for a clutching operation.

The manual stand 2 is provided with an acceleration lever 7a which is connected at its base portion with the first accelerating cable 5a, and a clutch lever 7b which is connected at its base portion with the first clutching cable 5b. Accordingly, when an operator inclines the acceleration lever 7a, the accelerating operation is carried out and when the operator inclines the clutch lever 7b, the clutching operation is carried out. These will hereinafter be called "manual operation". It should be noted that numeral 25 denotes a neutral switch to be described later which is provided for detecting whether or not the clutch lever 7b is in the neutral position.

The electrically-driven actuator 3 includes an acceleration driving part 8a and a clutch driving part 8b. The acceleration driving part 8a a clutch comprises means 9a for connection or disconnection between the first accelerating cable 5a and the second accelerating cable 6a, and an acceleration motor 10a for driving the second accelerating cable 6a. Similarly, the clutch driving part 8b comprises a clutch means for connection or disconnection between the first and second clutching cables 5b and 6b, and a clutch motor 10b for driving the second clutching cable 6b. The accelerating operation and clutching operation in the two driving parts 8a and 8b will hereinafter be called "electrically-driven operation". The two driving parts 8a and 8b will be described in more detail later.

The controller unit 4 comprises a selector switch 11 for selecting the manual operation or the electrically-driven operation, an acceleration regulator 12, and a clutch switch 13 for switching a gearbox to assume a forward, neutral or rearward position.

The operation of the control system thus constructed will be described in brief.

First, when the operator changes over the selector switch 11 to select the manual operation, the clutch means 9a and 9b in the electrically-driven actuator 3 connect the first cables 5a and 5b with the second cable 6a and 6b, respectively. Thereby, the manual operation is enabled. Accordingly, inclining the clutch lever 7b makes it possible to switch the gearbox to assume a ahead (forward), astern (rearward) or neutral position. On the other hand, inclining the acceleration lever 7a causes the engine to revolve at an increased or decreased number of revolutions.

In turn, when the operator changes over the selector switch 11 to select the electrically-driven operation, the clutch means 9a and 9b disconnect the first cables 5a and 5b with the second cables 6a and 6b, respectively. Next, if the clutch switch 13 is made to assume an ahead, astern or neutral position, the clutch motor 10b revolves to drive the second clutching cable 6b only. Then, operating the acceleration regulator 12 causes the acceleration motor 10a to revolve so as to drive the second accelerating cable 6a only, thereby making the engine revolve at a desired number of revolutions.

Thus, the second cables 6a and 6b are disengaged with the first cables 5a and 5b. Then, the second cables 6a and 6b are disengaged with the manual stand 2. Accordingly, there is not any problem even if the manual stand 2 is in the locked state. In addition, only the second cables 6a and 6b are driven in the electrically-driven operation, with the result that the operation efficiency increases remarkably as compared with the conventional control system.

Description will be made on the two driving parts 8a and 8b of the electrically-driven actuator 3 with reference to FIGS. 2 and 3. It should be understood that since the two driving parts 8a and 8b are of the same shape and structure, only the acceleration driving part 8a will be described as the representative thereof.

Figure 3:
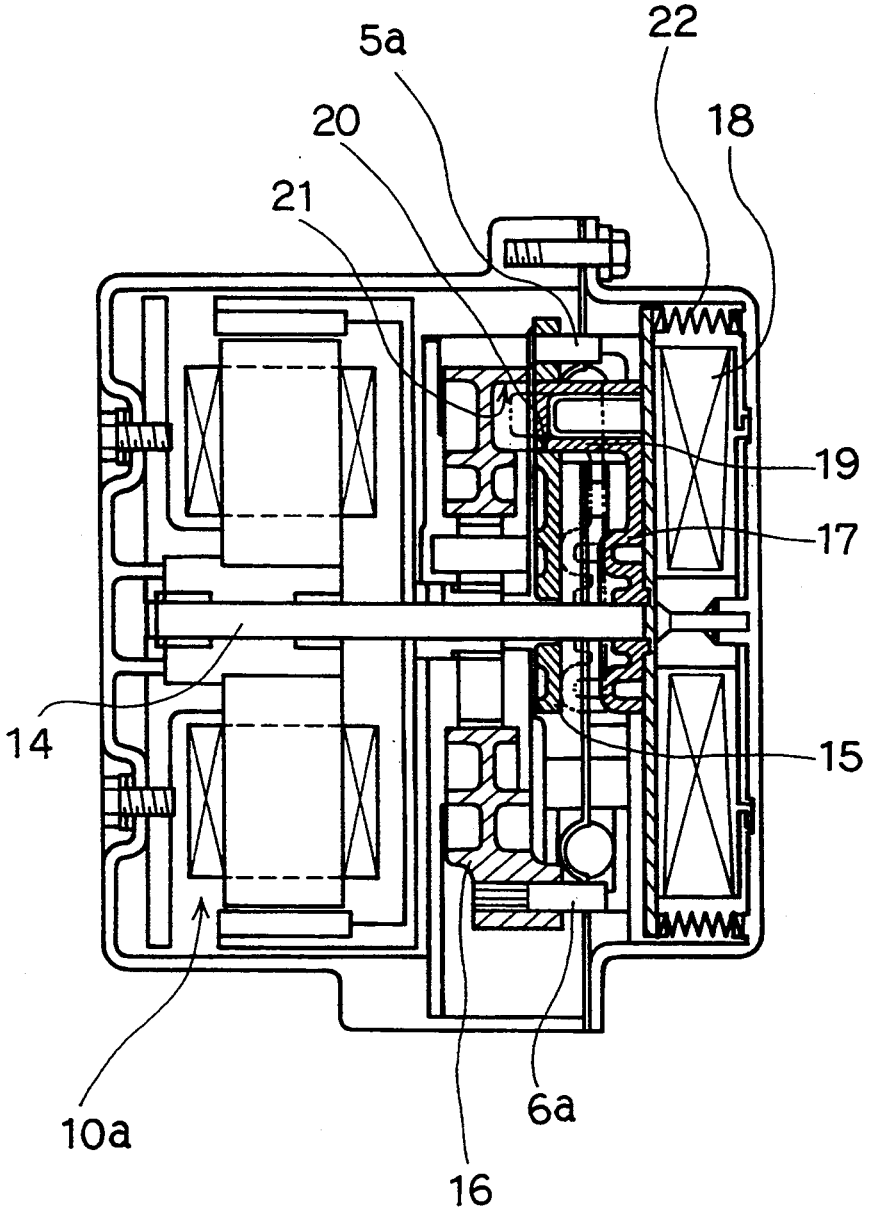
FIG. 3 is a sectional view taken along line III—III of FIG. 2.

Referring first to FIG. 3, on an output shaft of the acceleration motor 10a, two arms 15 and 16 are mounted. The first arm 15 is rotatably mounted on the output shaft 14 and engaged with one end of the first accelerating cable 5a. On the other hand, the second arm 16 is secured to the output shaft 14 and engaged with one end of the second accelerating cable 6a. Further, a solenoid 18 is provided which has a plunger 17 slidable along the output shaft 14.

The plunger 17 is formed with an engagement projection 19 at a face opposite to the first arm 15. On the other hand, the first arm 15 is formed with a first engagement hole 20 which is engageable with the engagement projection 19 of the plunger 17. The second arm 16 is formed with a second engagement hole 21 which corresponds to the first engagement hole 20 of the first arm 15.

Around the solenoid 18, a coiled spring 22 in a compressed condition for urging the plunger 17 toward the two arms 15 and 16 is disposed so as to allow the engagement projection 19 to be inserted into and engaged with both the first and second engagement holes. The solenoid 18, when the solenoid 18 is excited by applying electric current, attracts the plunger 17 against the urging force of the coiled spring 22 so as to cause the engagement projection 19 to be drawn out of the second engagement hole 21 but not of the first engagement hole 20.

When the engagement projection 19 of the plunger 17 is inserted into both the two engagement holes 20 and 21, the first and second arms 15 and 16 are coupled with each other, with the result that the first and second accelerating cables 5a and 6a are connected with each other for the manual operation. On the other hand, when the engagement projection 19 is drawn out of the first engagement hole 20 because of excitation of the solenoid 18, the first and second accelerating cables 5a and 6a are disengaged with each other for the electrically-driven operation.

By virtue of such an arrangement, in the manual operation, the first accelerating cable 5a causes the output shaft 14 to rotate, through the first arm 15, engagement projection 19 and second arm 16. In this case, no hindrance against the manual operation would occur with use of a motor for direct driving with low-speed and high-torque properties as the acceleration motor 10a or a gearbox generating no self-locking force, for example, one having a small reduction gear ratio and a small frictional resistance.

Next, the operation of the control system 1 shown in FIG. 1 will be described in more detail with reference to FIGS. 4 and 5.

Figure 4:
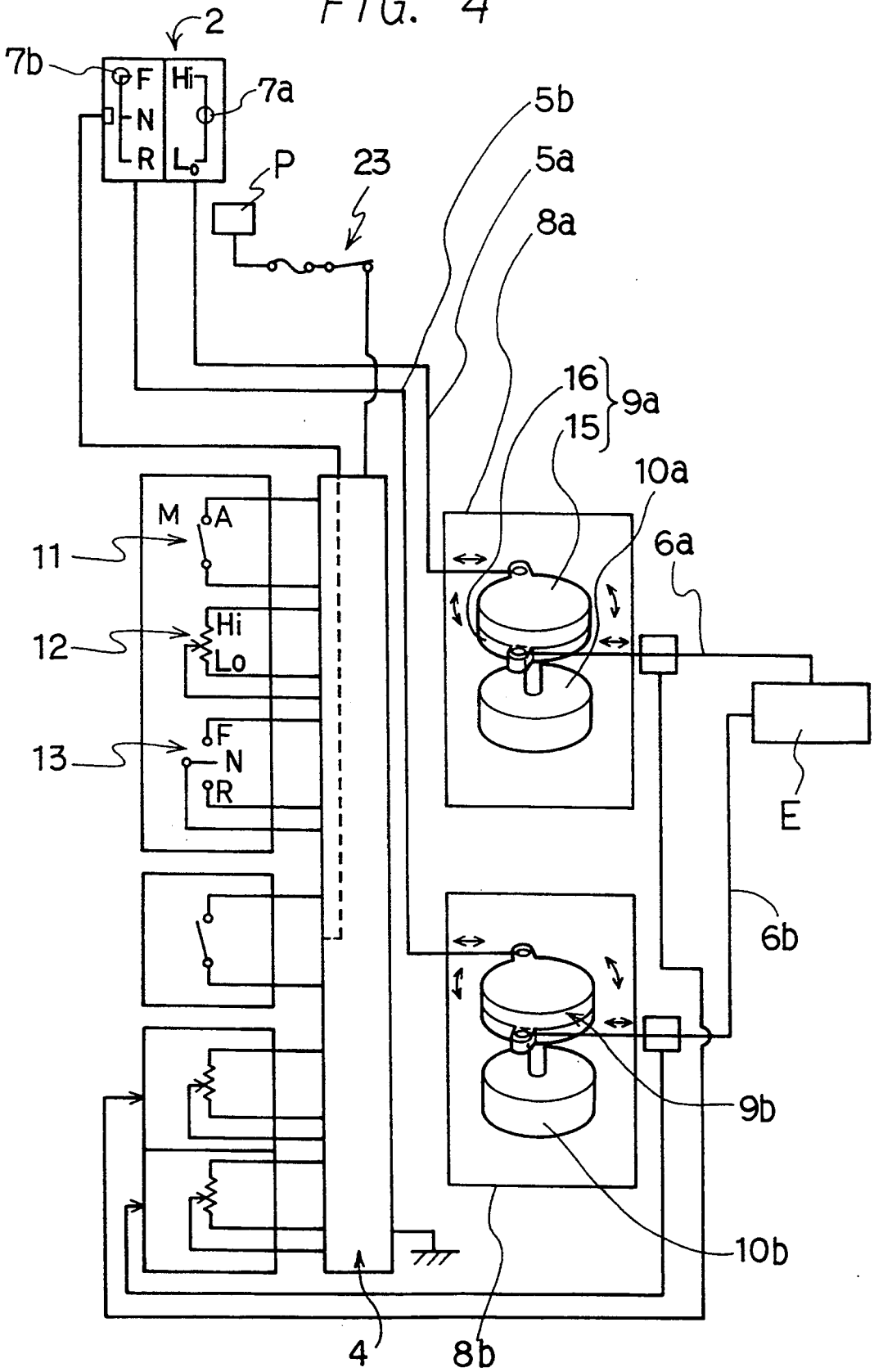
FIG. 4 is a system diagram for illustrating the operation state of the control system of FIG. 1 in the manual operation.

FIG. 4 illustrates how the control system of the present invention works in the manual operation.

First, a main switch 23 is closed. In this case, the selector switch 11 is already opened, which indicates the state that the selector switch has been changed over to the manual operation M. In this condition, neither the acceleration regulator 12 nor the clutch switch 13 works. As described above, in both the acceleration driving part 8*a* and the clutch driving part 8*b*, respective engagements of the clutch means 9*a* and 9*b* have been achieved and, hence, neither the acceleration motor 10*a* nor the clutch motor 10*b* works. Accordingly, all the operations in this condition are achieved with the acceleration lever 7*a* and clutch lever 7*b* of the manual stand 2.

Figure 5:
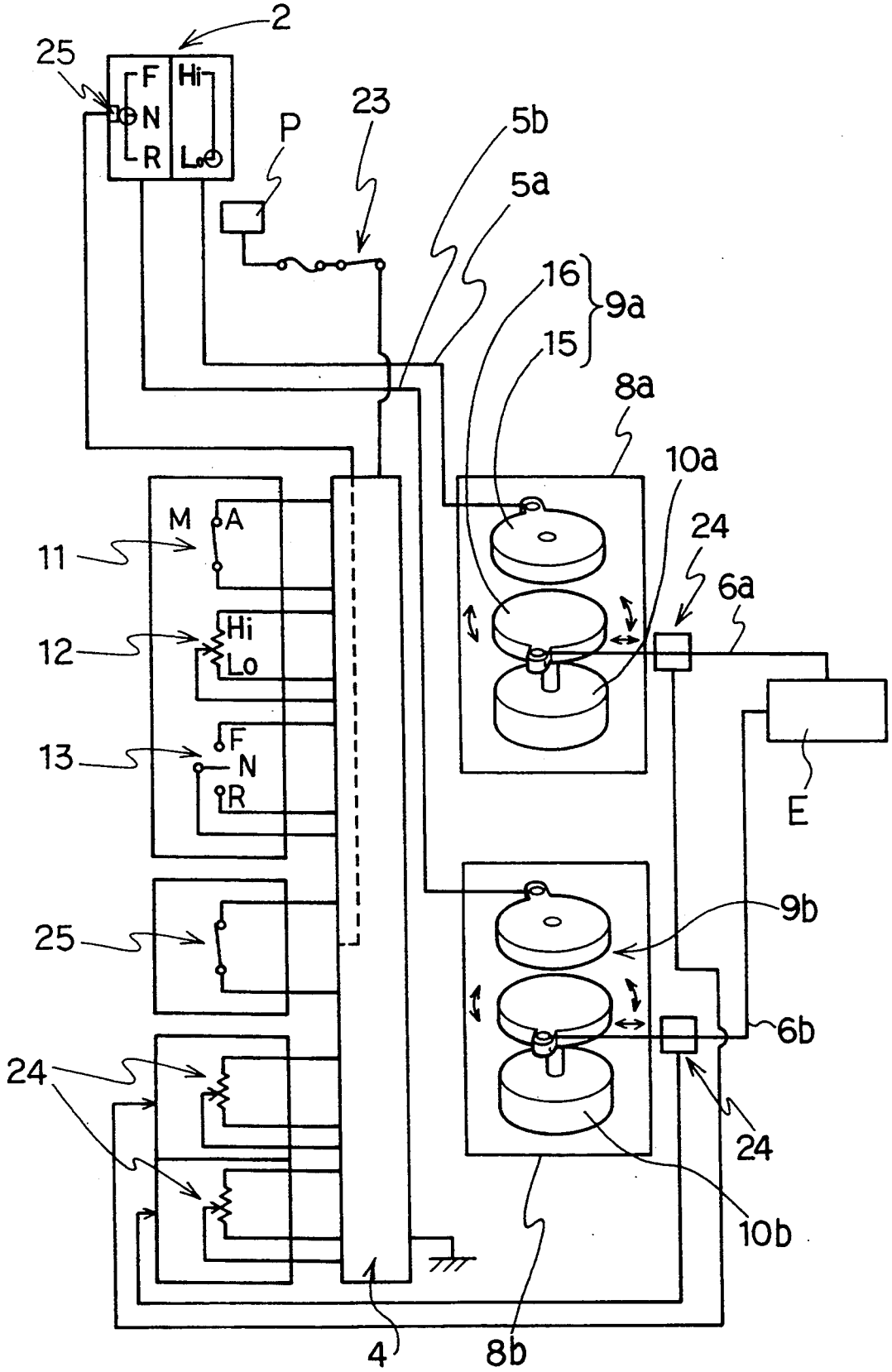
FIG. 5 is a system diagram for illustrating the operation state of the control system of FIG. 1 in the electrically-driven operation.
Figure 6:
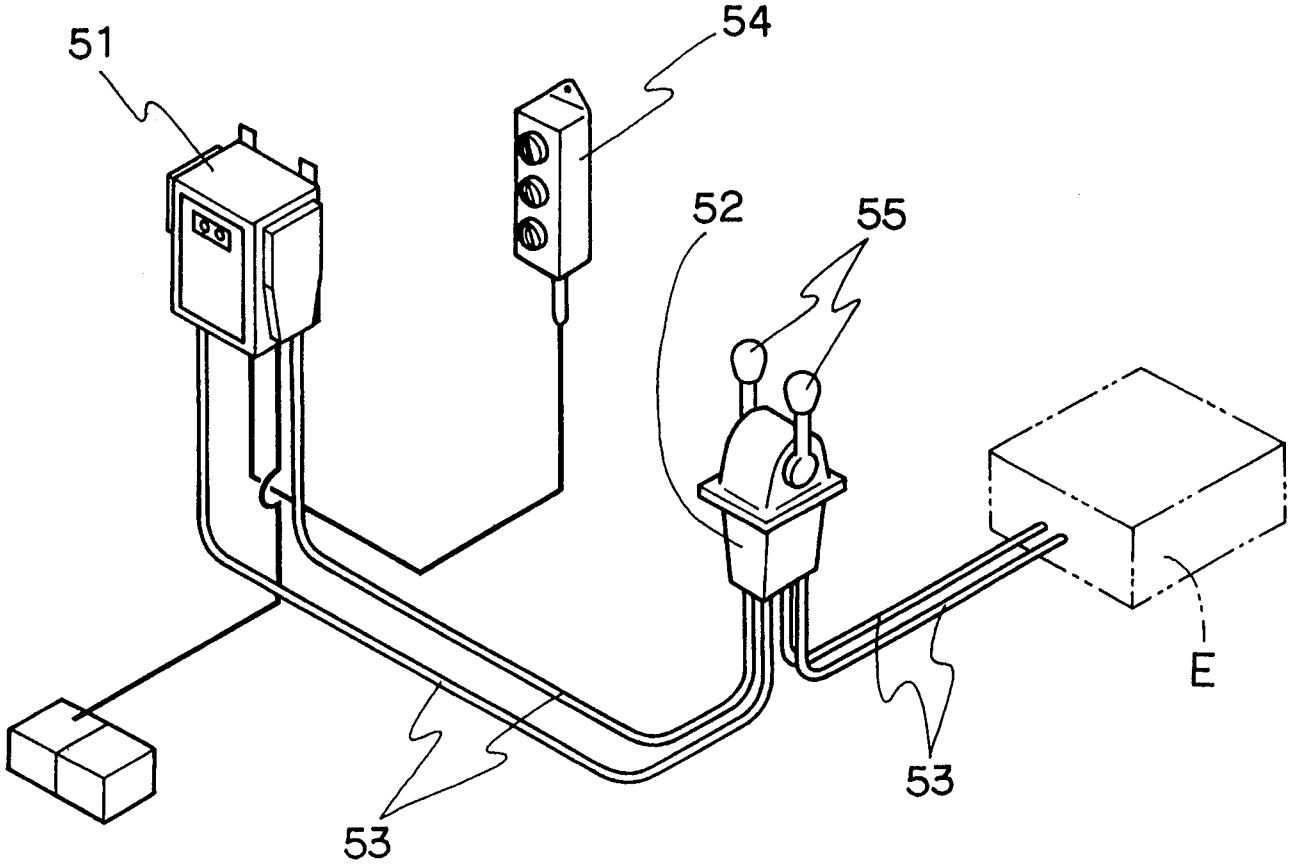
FIG. 6 PRIOR ART
FIG. 6 is a schematic explanatory view of a prior art control system.

FIG. 5 illustrates how the control system works in the electrically-driven operation.

First, the main switch 23 is closed. Subsequently, the acceleration lever 7*a* of the manual stand 2 is set to the Lo position for idling while the clutch lever 7*b* thereof to the neutral position. The selector switch 11 is changed over to the electrically-driven operation A. In response to this, the clutch means 9*a* and 9*b* in the two driving parts 8*a* and 8*b* disconnect the first accelerating cable 5*a* from the second accelerating cable 6*a* and the first clutching cable 5*b* from the second clutching cable 6*b*, respectively. Thereafter, the clutch switch 13 and the acceleration regulator 12 are operated to control the engine.

In the above condition, even if the clutch switch 13 is changed over to assume a position (forward F, rearward R or the like) other than the neutral position, such changing over to the forward F or rearward R is cancelled. In other words, such changing over is not taken effect. In such a case, accordingly, the clutch switch 13 needs to be changed over to the neutral position once, then to the forward F or rearward R position so as to actuate the system. This arrangement prevents faulty operations such as a sudden move of the ship upon changing over of the selector switch 11 alone to the electrically-driven operation A, thereby improving the safety of the system.

When the acceleration regulator 12 is set to a desired amount of acceleration, the acceleration driving part 8*a* causes the acceleration motor 10*a* to revolve in the forward or rearward direction in an mount corresponding to the amount set by the acceleration regulator 12, so as to push or pull the second accelerating cable 6*a* thereby regulating the governor opening of the engine E.

Figure 2:
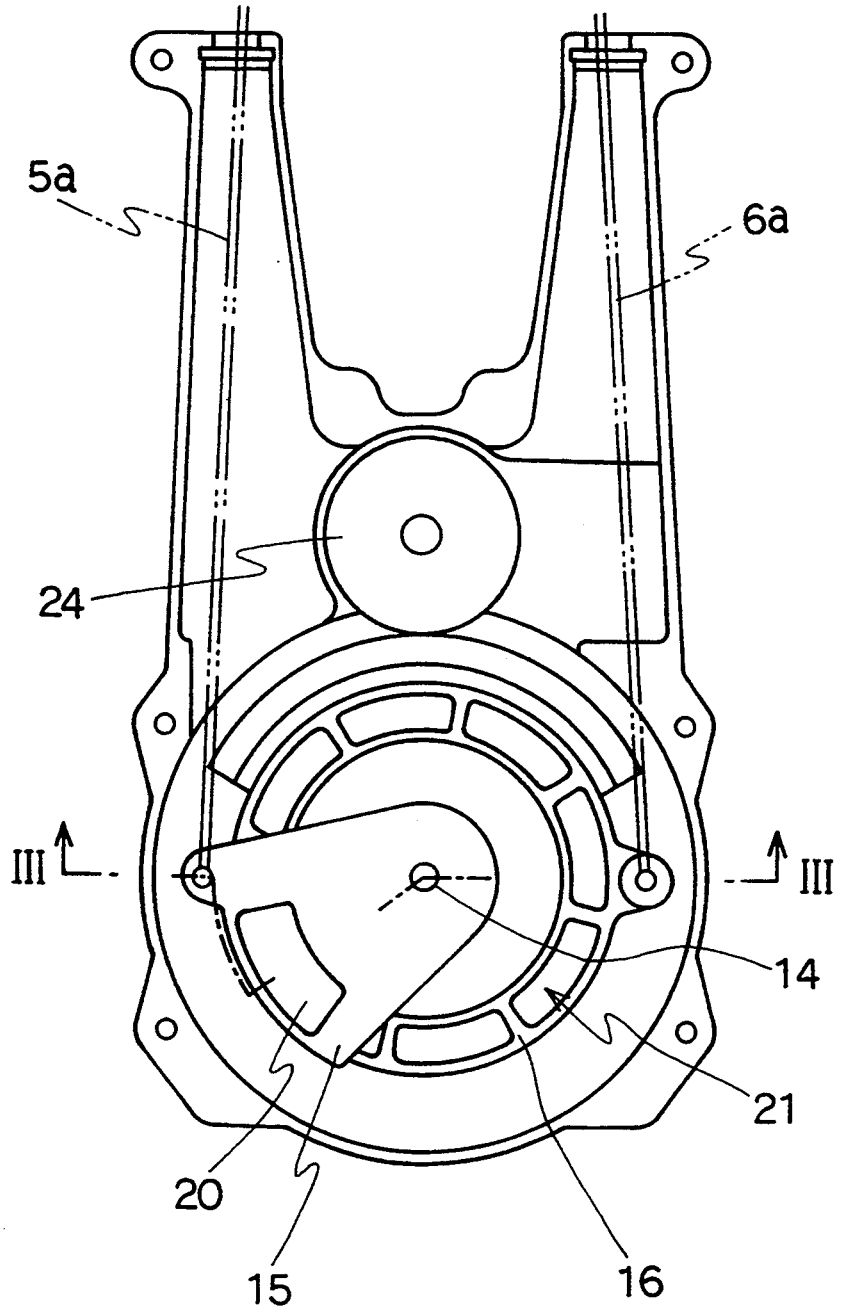
FIG. 2 is a front view showing the internal structure of an electrically-driven actuator shown in FIG. 1.

In association with each of the second cables 6*a* and 6*b*, there is provided a stroke sensor, for example, a potentiometer 24 abutting the second arm 16 as shown in FIG. 2. By virtue of these potentiometer 24, the amounts of respective displacement of the second cables 6*a* and 6*b* are measured, and the driving of individual cables is stopped when the measured amounts correspond to the inputs from the acceleration regulator 12 and clutch switch 13.

It should be noted that in an emergency such as a failure of the controller unit 4, it is possible to change over the operation to the manual operation by turning off the main switch 23 to stop exciting the solenoid 18 in each of the clutch means 9*a* and 9*b* thereby connecting the first cables 5*a* and 5*b* with the second cables 6*a* and 6*b*, respectively.

To be described next is the priority of the manual operation over the electrically-driven operation.

In the electrically-driven operation, if the clutch lever 7*b* of the manual stand 2 is inclined to a position (forward F, rearward R or the like) other than the neutral position, a neutral switch 25 detects that fact and feeds a detection signal to the controller unit 4. In response to this, the controller unit 4 cancels the electrically-driven control (electrically-driven operation) and changes over to the manual operation. In detail, the solenoid 18 of the electrically-driven actuator 3 ( see FIG. 3 ) is turned off, and in response thereto the respective clutch means 9*a* and 9*b* in the two driving part 8*a* and 8*b* connect the first cables 5*a* and 5*b* with the second cables 6*a* and 6*b*. By virtue of this arrangement, the operation of the system can be immediately switched to the manual operation, which is controlled by the manual stand 2, in case of emergency or the like. Thus, the operability and safety of the control system is improved.

As has been described, with the control system according to the present invention there occurs no inconvenience even if the manual control stand is locked in the electrically-driven operation because the manual control stand is disabled in the electrically-driven operation.

Further, the electrically-driven actuator push-pull drives only the second cables. Hence, the operation efficiency can be improved while a small-sized motor can be employed. As a result, the control system can be made compact and inexpensive. It should be understood that disposition of the actuator near the engine would contribute to a further rise in operation efficiency.

Though several embodiments of the present invention are described above, it is to be understood that the present invention is not limited only to the above-mentioned, various changes and modifications may be made in the invention without departing from the spirit and scope thereof.

What is claimed is:

1. A marine engine control system comprising a manual remote control stand, an electrically-driven actuator, a controller unit, a first control cable connecting the manual remote control stand with the electrically-driven actuator, and a second control cable connecting the electrically-driven actuator with a subject device to be controlled, wherein the manual remote control stand has an operational lever connected at a base portion thereof to the first control cable, wherein the electrically-driven actuator is provided with a clutch means for achieving connection and disconnection between the first control cable and the second control cable and a motor for driving the second control cable, and wherein the controller unit has a switch means for changing over between a manual operation by the manual remote control stand and an electrically-driven operation by the electrically-driven actuator.

2. A marine engine control system of claim 1, wherein said controller unit is provided with a cancelling means for changing over said electrically-driven operation to said manual operation when the operational lever is manipulated in said electrically-driven operation.

3. A marine engine control system of claim 1, wherein said clutch means comprises a first arm having an engagement hole rotatably mounted on an output shaft of said motor and engaged with said first control cable.

4. A marine engine control system of claim 3, wherein said clutch means further comprises a second arm having an engagement hole secured to the output shaft of said motor and engaged with said second control cable.

5. A marine engine control system of claim 4, wherein said clutch means comprises a plunger having an engagement projection capable of engaging with both the engagement holes, and an elastic member for urging the plunger toward the two arms so as to have the engagement projection engaged with both the engagement holes.

6. A marine engine control system of claim 5, wherein said clutch means further comprises a solenoid for attracting the plunger against the urging force of the elastic member when energized, so as to pull the engagement projection out of at least the engagement hole of the second arm.

7. A marine engine control system comprising a manual remote control stand, an electrically-driven actuator, a controller unit, a first control cable connecting the manual remote control stand with the electrically-driven actuator, and a second control cable connecting the electrically-driven actuator with a subject device to be controlled, wherein the manual remote control stand has an operational lever connected at a base portion thereof to the first control cable, wherein the electrically-driven actuator is provided with a clutch means for achieving connection and disconnection between the first control cable and the second control cable and a motor for driving the second control cable, wherein the controller unit has a switch means for changing over between a manual operation by the manual remote control stand and an electrically-driven operation by the electrically-driven actuator; and wherein said clutch means comprises a first arm having an engagement hole, rotatably mounted on an output shaft of said motor and engaged with said first control cable, a second arm having an engagement hole, secured to the output shaft of said motor and engaged with said second control cable, a plunger having an engagement projection capable of engaging with both the engagement holes, an elastic member for urging the plunger toward the two arms so as to have the engagement projection engage with both the engagement holes, and a solenoid for attracting the plunger against the urging force of the elastic member when energized, so as to pull the engagement projection out of at least the engagement hole of the second arm.

* * * * *